US011491798B2

(12) United States Patent
Ito

(10) Patent No.: US 11,491,798 B2
(45) Date of Patent: Nov. 8, 2022

(54) LIQUID DISCHARGE DEVICE

(71) Applicant: BROTHER KOGYO KABUSHIKI KAISHA, Nagoya (JP)

(72) Inventor: Tetsuo Ito, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/197,916

(22) Filed: Mar. 10, 2021

(65) Prior Publication Data

US 2021/0283932 A1 Sep. 16, 2021

(30) Foreign Application Priority Data

Mar. 10, 2020 (JP) ..... JP2020-040492
Mar. 10, 2020 (JP) ..... JP2020-040495
May 29, 2020 (JP) ..... JP2020-094902

(51) Int. Cl.
*B41J 2/175* (2006.01)

(52) U.S. Cl.
CPC ..... *B41J 2/1752* (2013.01)

(58) Field of Classification Search
CPC ..... B41J 2/1752
See application file for complete search history.

(56) References Cited

U.S. PATENT DOCUMENTS 7,845,779 B2 12/2010 Nip
8,678,574 B2 3/2014 Adachi
10,414,163 B2 9/2019 Sing et al.
2002/0163566 A1 11/2002 Jang et al.
2003/0214557 A1 11/2003 Nakamura et al.
2006/0146110 A1 7/2006 Tsuji
2008/0024571 A1 1/2008 Nip
2009/0040268 A1 2/2009 Miyazawa
2011/0261106 A1 10/2011 Murase
2013/0235130 A1 9/2013 Adachi
2015/0054890 A1 2/2015 Takeuchi et al.
2017/0050453 A1 2/2017 Igawa
2018/0311961 A1 11/2018 Kiuchi et al.
2018/0319169 A1 11/2018 Sing et al.
2019/0299682 A1 10/2019 Kano

FOREIGN PATENT DOCUMENTS

CN 1445095 A 10/2003
CN 2931122 Y 8/2007
CN 102239051 A 11/2011
(Continued)

OTHER PUBLICATIONS

Extended European Search Report dated Jul. 30, 2021 in connection with the European Patent Application No. 21161446.6.
(Continued)

*Primary Examiner* — Justin Seo
(74) *Attorney, Agent, or Firm* — K&L Gates LLP

(57) ABSTRACT

A printer is provided with a mounting portion and an arm. A head is mounted on the mounting portion. The head discharges a liquid. The arm can move between a fixed position and a released position. In the fixed position, the arm fixes the head mounted on the mounting portion to the mounting portion in a first direction, a second direction, and a third direction. In the released state, the arm unfixes the head from the mounting portion.

7 Claims, 8 Drawing Sheets

(56) References Cited

FOREIGN PATENT DOCUMENTS

| | | | | | |
|---|---|---|---|---|---|
| CN | 104136222 | A | | 11/2014 | |
| CN | 104553319 | B | * | 9/2016 | ..... B41J 2/16511 |
| CN | 205890211 | U | | 1/2017 | |
| CN | 108349260 | A | | 7/2018 | |
| CN | 110315855 | A | | 10/2019 | |
| EP | 1344650 | A1 | | 9/2003 | |
| JP | 2009-039941 | A | | 2/2009 | |
| JP | 2012-161992 | A | | 8/2012 | |
| JP | 2018-187824 | A | | 11/2018 | |
| JP | 2019-1028 | A | | 1/2019 | |

OTHER PUBLICATIONS

Office Action issued in corresponding Chinese patent application No. 202110254320.X, dated Apr. 29, 2022 (6 pages).
Office Action issued in the corresponding Chinese Patent Application No. 202110254320.X, dated Sep. 16, 2022. (3 pages.).

* cited by examiner

LIQUID DISCHARGE DEVICE

CROSS-REFERENCE TO RELATED APPLICATION

This application claims priority to Japanese Patent Application No. 2020-040492 filed Mar. 10 2020, Japanese Patent Application No. 2020-040495 filed Mar. 10 2020, and Japanese Patent Application No. 2020-094902 filed May 29 2020. The contents of the foregoing application are hereby incorporated herein by reference.

BACKGROUND

The present disclosure relates to a liquid discharge device.

A liquid discharge device provided with a mounting portion to which a head is mounted, which discharges liquid from the head, is known. In an image forming device, a head is mounted on a base frame, and ink is discharged from the head. A reference surface is provided on the head, and a positioning pin is provided on the base frame. The head is mounted on the base frame by abutting the reference surface against the positioning pin. At this time, an operator holds the head with a jig so that the head does not move with respect to the base frame. In this state, the operator fixes the head to the base frame with a screw.

SUMMARY

In the aforementioned image forming device, the operator needs to hold the head with a jig so that the head does not move with respect to the base frame, before fixing the head to the base frame with the screw. Therefore, the work of fixing the head to the base frame was troublesome.

Embodiments of the broad principles derived herein provide a liquid discharge device in which a head can easily be fixed to a mounting portion.

A liquid discharge device includes a mounting portion to which a head configured to discharge a liquid is mounted, and an arm configured to move between a fixed position where the head mounted on the mounting portion is fixed in a first direction, a second direction, and a third direction, all of which are orthogonal to each other, with respect to the mounting portion, and a released position where the head is unfixed from the mounting portion.

According to this aspect, when the arm is moved from the released position to the fixed position while the head is in a state mounted on the mounting portion, the head becomes fixed in all of the first direction, the second direction, and the third direction with respect to the mounting portion. Therefore, the liquid discharge device enables the head to be easily fixed to the mounting portion.

BRIEF DESCRIPTION OF THE DRAWINGS

Embodiments will be described below in detail with reference to the accompanying drawings in which.

DETAILED DESCRIPTION

Figure 1:
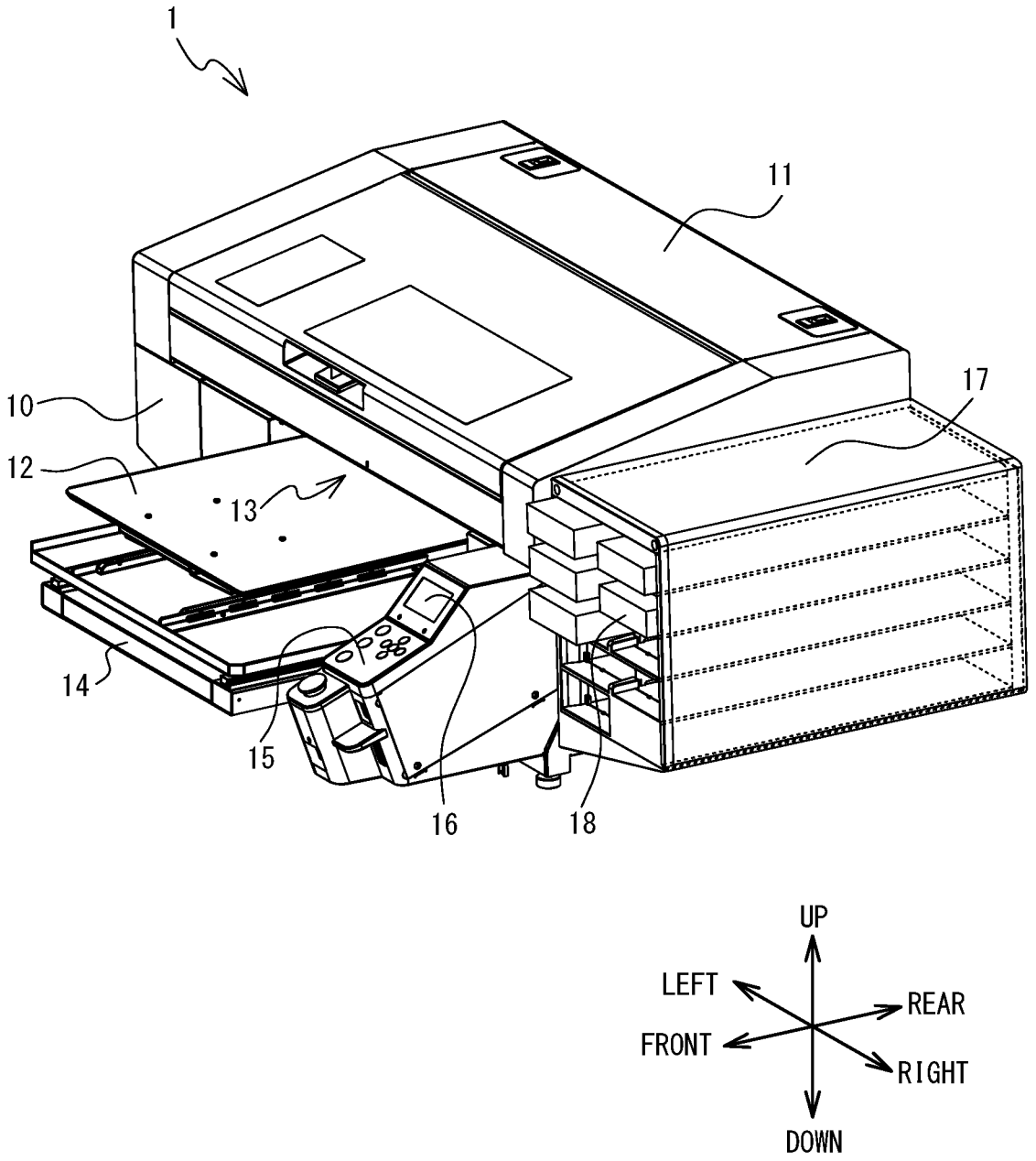
FIG. 1 is a perspective view of a printer.

A printer 1 related to one embodiment of the present disclosure will be described with reference to the drawings. The directions of up, down, lower left, upper right, lower right, and upper left in FIG. 1 correspond to the upper side, lower side, front, rear, right, and left, respectively, of the printer 1. The up-down direction in FIG. 1 is the vertical direction. In the present embodiment, the mechanical elements in the drawings are shown at actual scale.

The printer 1 shown in FIG. 1 is an inkjet printer, and performs printing by discharging ink onto a print medium of cloth or paper or the like. The printer 1 can print a color image on the print medium using five colors of ink, i.e., white, black, yellow, cyan, and magenta.

Hereinafter, of the five colors of ink, the white-colored ink will be referred to as "white ink", and the other four colors of ink, i.e., black, cyan, yellow, and magenta, will collectively be referred to as "color ink". When collectively referring to the white ink and the color ink, or when neither is specified, they will simply be referred to as "ink". The white ink is used for printing as a white part of an image or as a base for inks of other colors. The color ink is used for printing a color image and is discharged directly onto the print medium or onto a base of white ink.

The outer structure of the printer 1 will now be described referring to FIG. 1. The printer 1 includes a case 10 and a lid 11. The case 10 is U-shaped when viewed from the front. An opening 13 is formed in the case 10. The opening 13 extends from the front side of the case 10 rearward. The lid 11 is provided on the upper side of the case 10, and is able to be opened to a position where the upper side of the case 10 is open, and closed to a position where the upper side of the case 10 is covered, by being rotated with the rear end of the lid 11 as the axis.

Operating buttons 15 and a display screen 16 are provided on the right side of the opening 13 on the front surface of the case 10. The operating buttons 15 input various information to the printer 1 in accordance with an operation by an operator. The display screen 16 displays various information. Therefore, the operator operates the printer 1 from the front side of the printer 1. That is, in the present embodiment, the front side of the printer 1 is the front of the printer 1.

A platen 12 is disposed in the opening 13. The platen 12 has a plate shape, and is supported from below by a support portion 14 so as to be able to move in the front-rear direction. The support portion 14 is fixed to a frame body 2 shown in FIG. 2 inside the opening 13. The platen 12 moves in the front-rear direction by the driving of a sub-scanning motor (not shown in the drawings). Therefore, in the present embodiment, the front-rear direction is the sub-scanning direction.

The platen 12 can protrude farther forward than the front surface of the case 10, i.e., forward of a front shaft 21, by moving forward, and can move farther rearward than a rear shaft 22 inside the case 10 by moving rearward. The operator arranges the print medium on the upper surface of the platen 12 while the platen 12 is protruding forward from the front of the case 10. An accommodation portion 17 is provided on the right side of the case 10. A plurality of cartridges 18 are placed in the accommodation portion 17 from the front side. The cartridges 18 contain various liquids such as ink used for printing.

Figure 2:
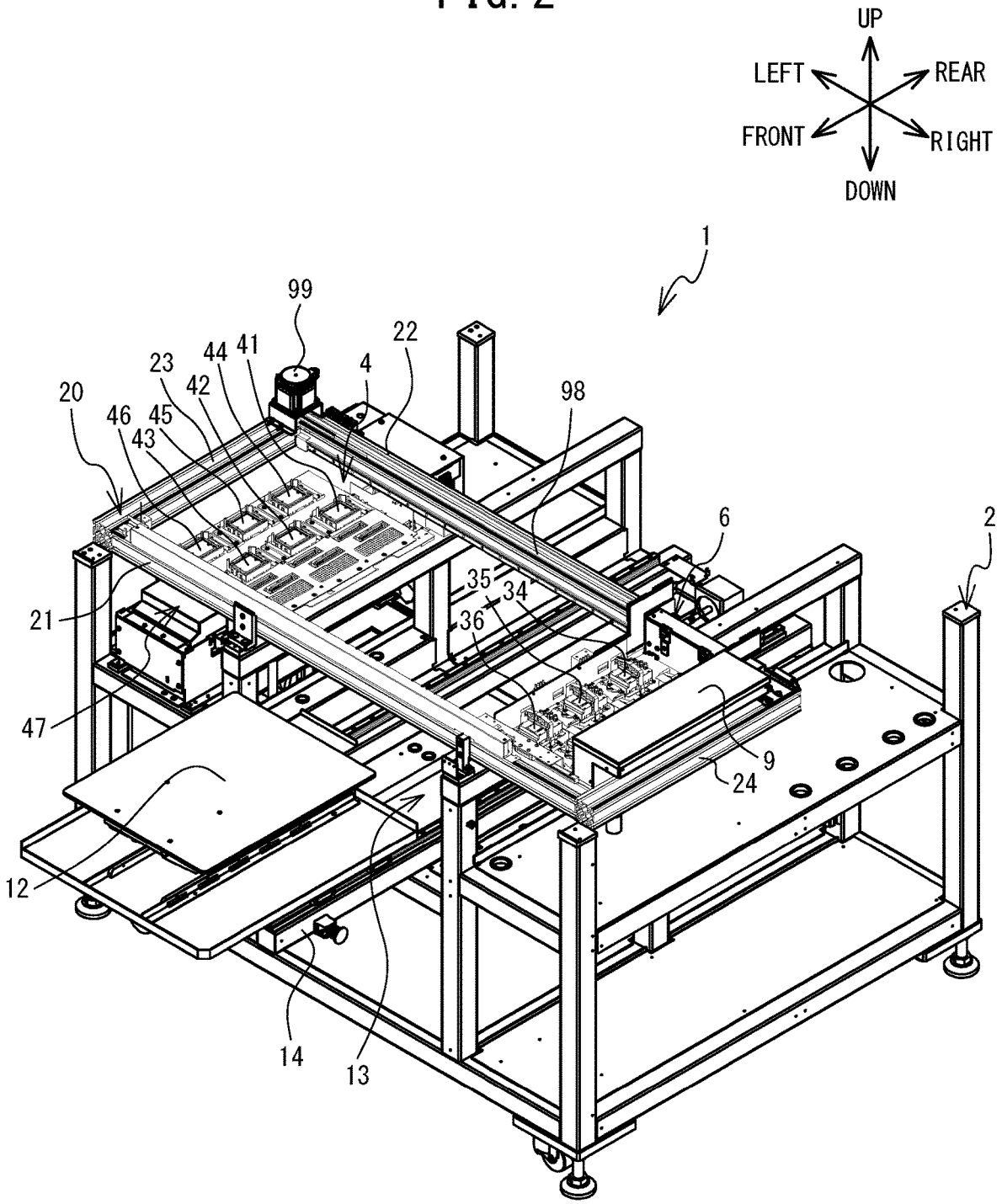
FIG. 2 is a perspective view showing the internal structure of the printer.

The internal structure of the printer 1 will now be described with reference to FIG. 2 and FIG. 3. As shown in FIG. 2, the frame body 2 is provided inside the case 10 shown in FIG. 1. The frame body 2 is formed in a lattice shape by a plurality of shafts extending in the front-rear direction, a plurality of shafts extending in the left-right direction, and a plurality of shafts extending in the up-down direction. A guide shaft 20 is fixed to the upper end of the frame body 2. The guide shaft 20 is formed by the front shaft 21, the rear shaft 22, a left shaft 23, and a right shaft 24.

The front shaft 21 is disposed on a front end portion of the frame body 2, and extends in the left-right direction from the left end portion to the right end portion of the frame body 2. The rear shaft 22 is disposed in substantially the center in the front-rear direction of the frame body 2, and extends in the left-right direction from the left end portion to the right end portion of the frame body 2. The left shaft 23 is disposed on the left end portion of the frame body 2, and extends in the front-rear direction from the left end of the front shaft 21 to the left end of the rear shaft 22. The right shaft 24 is disposed on the right end portion of the frame body 2, and extends in the front-rear direction from the right end of the front shaft 21 to the right end of the rear shaft 22.

The front shaft 21 and the rear shaft 22 support a carriage 6. The carriage 6 is a plate, which extends from the front shaft 21 to the rear shaft 22. As shown in FIG. 3, six mounting portions 61 to 66 are provided on the carriage 6. Each of the mounting portions 61 to 66 is a region where a head, described later, is to be mounted, and includes both an opening passing through the carriage 6 in the up-down direction, and an area around the opening. The shape of the mounting portions 61 to 66 when viewed from above corresponds to the outer shape of the heads when viewed from above.

The mounting portions 61, 62, and 63 are disposed on the right side of the carriage 6, and are lined up in a row from the rear side toward the front side in the order of the mounting portion 61, the mounting portion 62, and the mounting portion 63. The mounting portions 64, 65, and 66 are disposed on the left side of the row of the mounting portions 61, 62, and 63, and are lined up in a row from the rear side toward the front side in the order of the mounting portion 64, the mounting portion 65, and the mounting portion 66.

A head can be mounted to each of the mounting portions 61 to 66. FIG. 2 shows an example of a state in which heads are mounted to mounting portions, and shows a state in which heads 31 to 36 are mounted to the mounting portions 61 to 66, respectively. Below, the state shown in FIG. 2 is assumed. The front shaft 21 and the rear shaft 22 are fixed to the frame body 2 and support the carriage 6. Therefore, the carriage 6 maintains a distance in the up-down direction between the heads 31 to 36 and the platen 12 in a state in which the heads 31 to 36 are mounted to the mounting portions 61 to 66, respectively. The distance in the up-down direction is not limited to a specific numerical value as long as the heads 31 to 36 do not contact the print medium. For example, the distance in the up-down direction between the heads 31 to 36 and the platen 12 may be approximately 0.5 mm to 10.0 mm. In this case, even if print mediums of different thicknesses are placed on the platen 12, the carriage 6 will maintain a distance in the up-down direction between the heads 31 to 36 and the print medium of approximately 0.1 mm to 10.0 mm.

White ink is supplied to each of the heads 31 and 34 from a white ink cartridge 18. A discharge agent is supplied from a discharge agent cartridge 18 to each of the heads 32 and 35. The discharge agent is a liquid for removing the color of the print medium. Color ink is supplied from color ink cartridges 18 to each of the heads 33 and 36.

Figure 3:
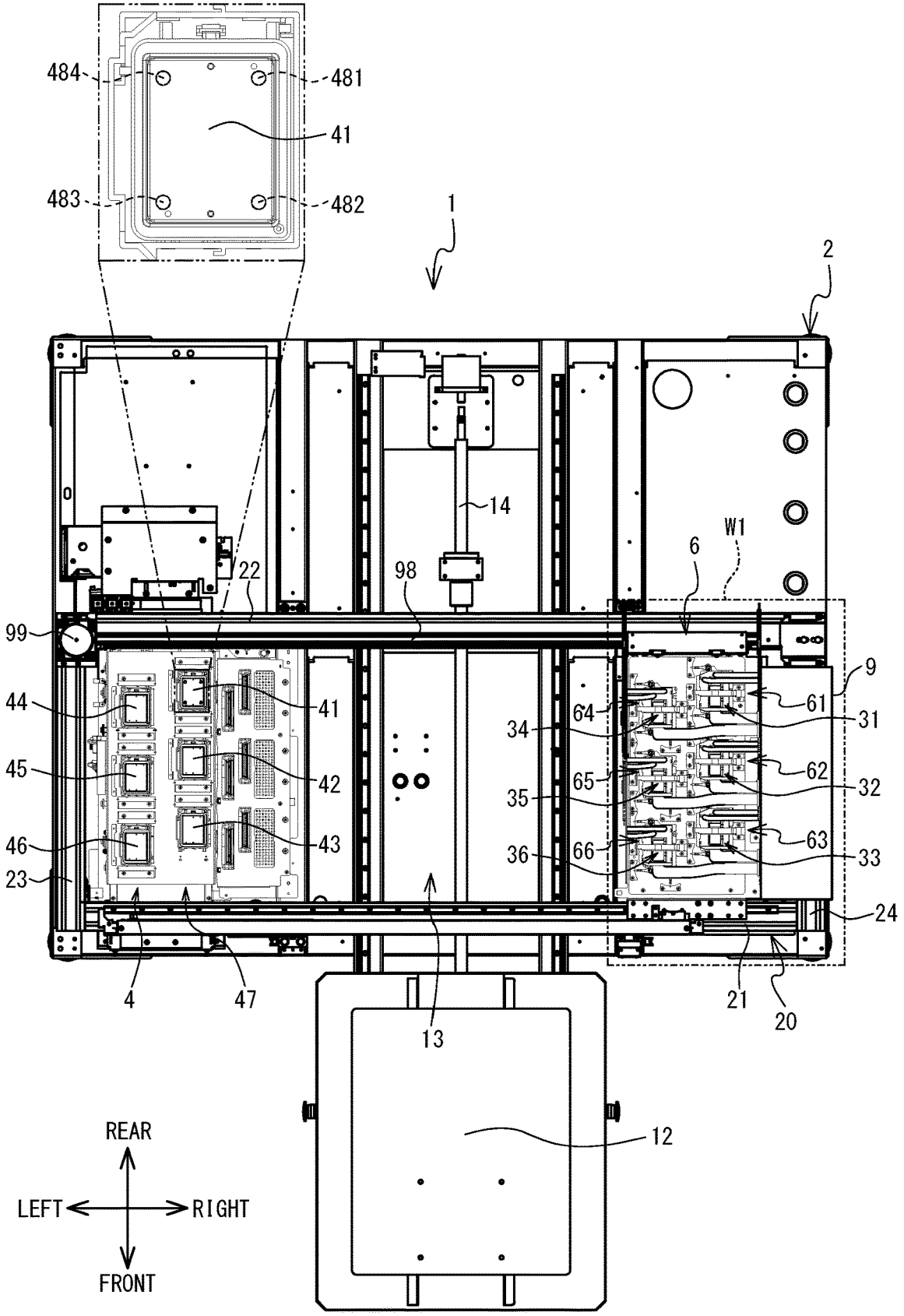
FIG. 3 is a plan view showing the internal structure of the printer.

As shown in FIG. 2 and FIG. 3, a drive belt 98 is connected to a rear end portion of the carriage 6. The drive belt 98 is provided on the rear shaft 22 and extends in the left-right direction. The left end portion of the drive belt 98 is connected to a main scanning motor 99. The main scanning motor 99 is provided on the upper side of the left end portion of the rear shaft 22. Driving the main scanning motor 99 causes the drive belt 98 to move the carriage 6 in the left-right direction along the front shaft 21 and the rear shaft 22. Therefore, in the present embodiment, the left-right direction is the main scanning direction. FIG. 2 and FIG. 3 show a state in which the carriage 6 is positioned on the right end of the moving range.

According to this structure, the printer 1 conveys the print medium in the front-rear direction and the left-right direction with respect to the heads 31 to 36 by causing the platen 12 to move in the front-rear direction (sub-scanning direction) by driving the sub-scanning motor (not shown in the drawings), and causing the carriage 6 to move in the left-right direction (main scanning direction) by driving the main scanning motor 99. The printer 1 discharges various liquids from the heads 31 to 36 while conveying the print medium in the front-rear direction and the left-right direction with respect to the heads 31 to 36. More specifically, the printer 1 first discharges the discharge agent from the heads 32 and 35 to remove color from the print medium. Alternatively, the printer 1 first discharges white ink from the heads 31 and 34 to form a base on the print medium. The printer 1 prints a color image by discharging color ink from the heads 33 and 36 on the portion of the print medium where color was removed or onto the base that was formed. Note that the printer 1 may discharge both the white ink and the discharge agent.

One example of the positional relationship between the mounting portions 61 to 66 will be described with reference to FIG. 4. There is a predetermined interval between the mounting portions 61 to 63 that are adjacent in the front-rear direction. Similarly, there is a predetermined interval between the mounting portions 64 to 66 that are adjacent in the front-rear direction.

The mounting portion 64 is offset forward with respect to the mounting portion 61, and overlaps with the front of the mounting portion 61 in the left-right direction. That is, the rear end of the mounting portion 64 is positioned between the front end of the mounting portion 61 and the rear end of the mounting portion 61 in the front-rear direction. The positional relationship between the mounting portion 65 and the mounting portion 62, and the positional relationship between the mounting portion 66 and the mounting portion 63 are also the same as the positional relationship between the mounting portion 64 and the mounting portion 61.

The mounting portion 62 is offset forward with respect to the mounting portion 64, and does not overlap with the mounting portion 64 in the left-right direction. That is, the rear end of the mounting portion 62 is positioned farther forward than the front end of the mounting portion 64. The positional relationship between the mounting portion 63 and the mounting portion 65 is also the same as the positional relationship between the mounting portion 62 and the mounting portion 64.

The specific structure of the heads 31 to 36 will now be described with reference to FIG. 4 to FIG. 6. The structures of the heads 31 to 36 are all the same, so the structure of the head 31 will be described and the descriptions of the heads 32 to 36 will be omitted or simplified.

Figure 5:
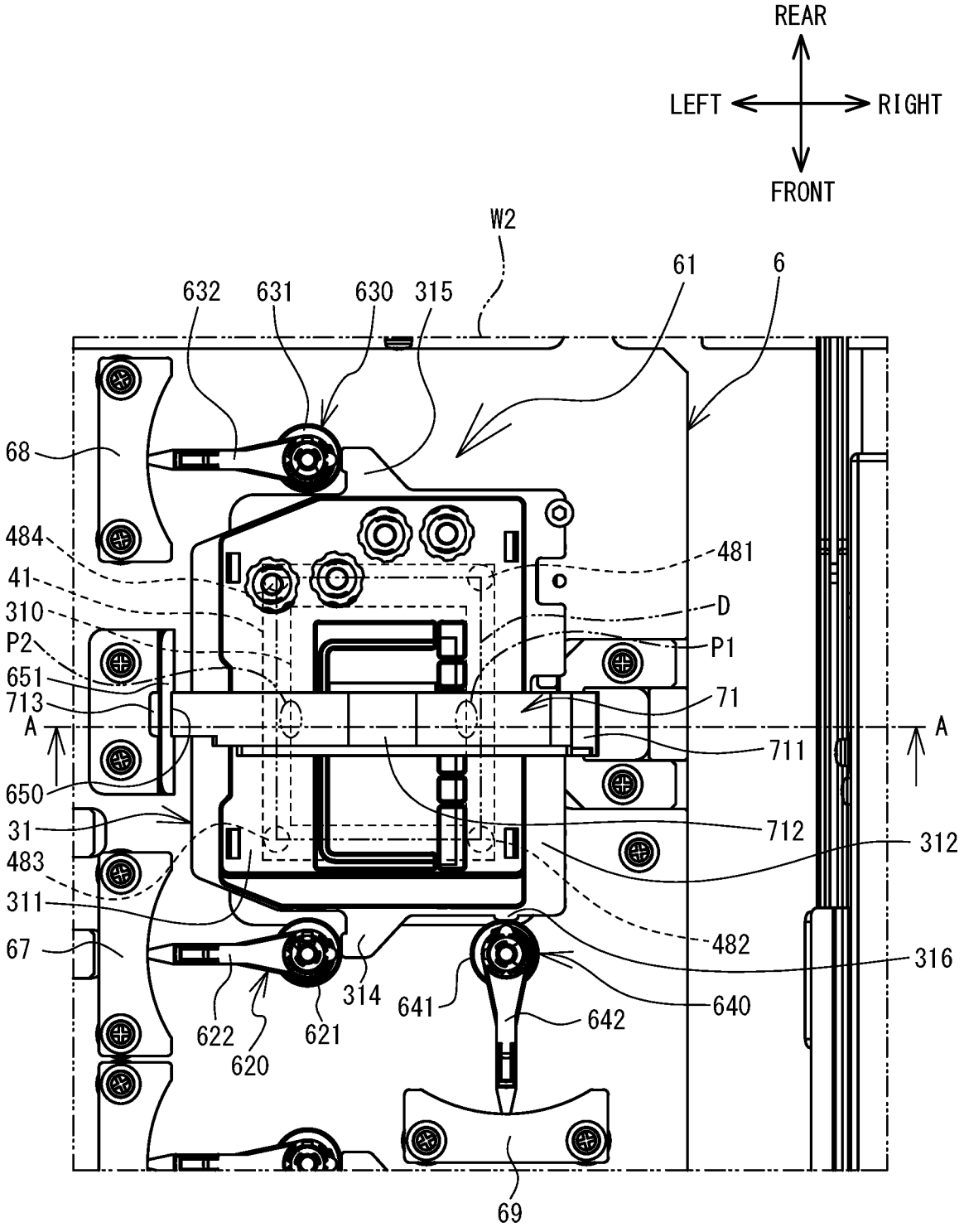
FIG. 5 is an enlarged view showing a state in which capping is performed with a cap in a region W2 in FIG. 4.
Figure 6:
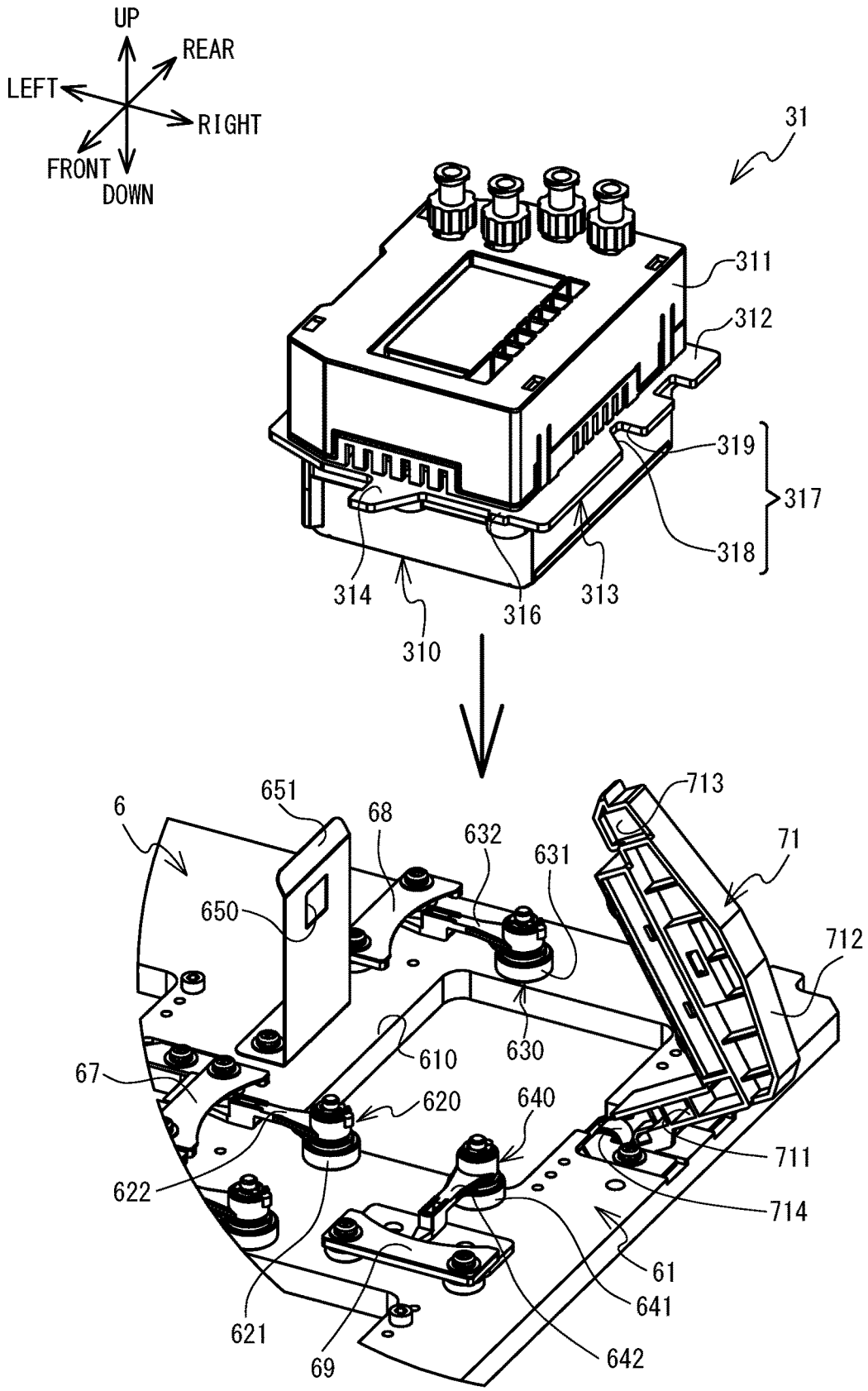
FIG. 6 is a perspective view showing the process by which a head is mounted on a mounting portion.

As shown in FIG. 5 and FIG. 6, the head 31 is provided with a head body 311 and a reference plate 312. The head body 311 has a substantially rectangular parallelepiped shape. A nozzle surface 310 is formed on the lower surface of the head body 311. A plurality of rows of a plurality of nozzles lined up in the front-rear direction are lined up in the left-right direction on the nozzle surface 310. The head 31 discharges white ink supplied from the cartridge 18 shown in FIG. 1 from each nozzle of the nozzle surface 310.

The reference plate 312 is provided in substantially the center, in the up-down direction, of the head body 311, and protrudes outward from each side surface, i.e., the front surface, the rear surface, the left surface, and the right surface, of the head body 311. As shown in FIG. 6, a contact portion 313 is provided on the lower surface of the reference plate 312.

As shown in FIG. 5, a contact portion 314 extends forward and protrudes toward the left from substantially the center in the left-right direction of the front end of the reference plate 312. A contact portion 315 extends rearward and protrudes toward the left from substantially the center in the left-right direction of the rear end of the reference plate 312. A contact portion 316 protrudes forward from farther toward the right than the contact portion 314 of the front end of the reference plate 312.

As shown in FIG. 6, a notch 317 is provided in substantially the center, in the front-rear direction, of the right end of the reference plate 312. The notch 317 includes an inclined surface 318 and a connecting surface 319. The inclined surface 318 extends rearward toward the left from the right end of the reference plate 312, and extends to the right side of the head body 311. The connecting surface 319 extends rearward toward the right from the left end of the inclined surface 318, and extends to the right end of the reference plate 312.

Figure 4:
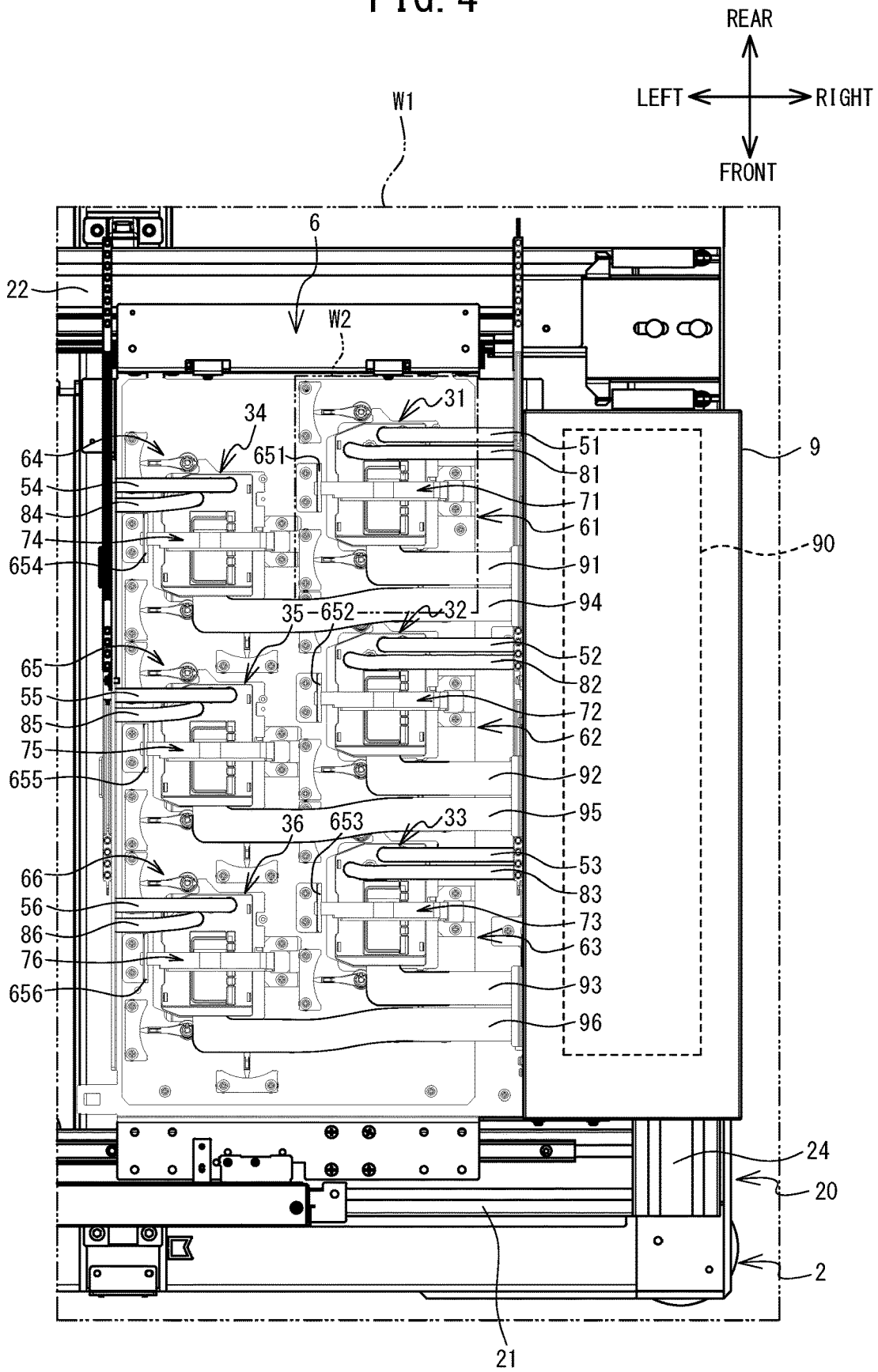
FIG. 4 is an enlarged view of a region W1 in FIG. 3.

As shown in FIG. 4, one end of each supply tube 51 to 56 and one end of each circulation tube 81 to 86 is connected to the rear end portion of the upper surface of the heads 31 to 36, respectively. The supply tubes 51 to 53 and the circulation tubes 81 to 83 extend from the heads 31 to 33, respectively, toward the right. The supply tubes 54 to 56 and the circulation tubes 84 to 86 extend from the heads 34 to 36, respectively, toward the left. The other ends of the supply tubes 51 to 58 and the other ends of the circulation tubes 81 to 86 are connected to the cartridges 18 shown in FIG. 1 via a supply flow passage (not shown in the drawings).

When printing is to be performed, the liquids supplied from the cartridges 18 flow through the supply tubes 51 to 56 and are supplied to the heads 31 to 36, respectively. When circulation of the liquids is to be performed, the liquids supplied from the cartridges 18 flow through the supply tubes 51 to 56 toward the heads 31 to 36, respectively, and then flow through the circulation tubes 81 to 86 and are returned to the cartridges 18 instead of being discharged from the heads 31 to 36. Circulation of the liquids is performed to maintain the fluidity of the ink by eliminating the sedimentation of the components contained in the ink, and the like.

A circuit board box 9 is provided on the right side of the heads 31 to 33. A circuit board 90 is disposed inside the circuit board box 9. In FIG. 4, the circuit board 90 covered by the circuit board box 9 is indicated by a broken line. The circuit board 90 is provided with a CPU, ROM, and RAM (not shown in the drawings), and the like, and controls the operation of the heads 31 to 36.

One end of each cable 91 to 96 is connected to the front surface of a corresponding head 31 to 36, respectively. The cables 91 to 96 each extend toward the right from the heads 31 to 36. The other ends of the cables 91 to 96 connect to the circuit board 90. The cables 91 to 96 are flexible flat cables (FFC) which transmit control signals from the circuit board 90 to the heads 31 to 36, respectively. The supply tube 51 and the cable 91 are omitted from FIG. 5 to simplify the description.

A cap mechanism 4 will be described with reference to FIG. 2, FIG. 3, and FIG. 5. As shown in FIG. 2 and FIG. 3, the cap mechanism 4 is provided on the left portion inside the case 10 shown in FIG. 1, and is provided with six caps 41 to 46 and a cap supporting portion 47. The caps 41 to 46 is provided below the movement path of the carriage 6 and to the left of the movement path of the platen 12. The positional relationship of each of the caps 41 to 46 is the same as the positional relationship of each of the mounting portions 61 to 66. The caps 41 to 46 each have a rectangular shape when viewed from above and are supported from below by the cap supporting portion 47. The cap supporting portion 47 can move the caps 41 to 46 in the up-down direction.

As shown in FIG. 3, four springs 481 to 484 are provided on the lower side of the cap 41. In FIG. 3, the four springs 481 to 484 covered by the cap 41 are indicated by broken lines. The four springs 481 to 484 each urge a different one of the four corners of the cap 41 upward from below. Although not shown in the drawings, four springs are also provided on the lower surface of each of the caps 42 to 46.

According to this structure, the head 31 is disposed above the cap 41 when the carriage 6 moves to the left end of the moving range, as shown in FIG. 5. FIG. 5 shows a state in which the carriage 6 is positioned at the left end of the moving range, with the caps 41 covered by the head 31, the four springs 481 to 484, and the nozzle surface 310 being indicated by broken lines. When the cap supporting portion 47 moves upward while the head 31 is in a state disposed above the cap 41, the cap 41 covers the nozzle surface 310 of the head 31 from below, thereby capping the nozzle surface 310. Similarly, the caps 42 to 46 shown in FIG. 3 cover the nozzle surfaces (not shown in the drawings) of the heads 32 to 36 shown in FIG. 3, respectively, from below, thereby capping those nozzle surfaces.

In this case, the springs 481 to 484 each urge the cap 41 toward the lower surface of the head 31. Similarly, the caps 42 to 46 are also urged toward the lower surfaces of the heads 32 to 36, respectively. As a result, the edges of the caps 41 to 46 closely contact the lower surfaces of the heads 31 to 36, respectively, so a gap is inhibited from forming between the edges of the caps 41 to 46 and the lower surfaces of the heads 31 to 36. In the printer 1, capping is performed with the caps 41 to 46 while printing is not being performed, in order to inhibit the ink and the discharge agent from drying out.

The specific structure around the mounting portions 61 to 66 will now be described with reference to FIG. 4 to FIG. 8. The structures around the mounting portions 61 to 66 are all the same, as shown in FIG. 4, so only the structure around the mounting portion 61 will be described; a description of the structures around the mounting portions 62 to 66 will be omitted or simplified.

Each mounting portion 61 to 66 is provided with an engagement plate 651 to 656 and an arm 71 to 76. Each engagement plate 651 to 656 is positioned in substantially the center, in the front-rear direction, on the left side of the mounting portion 61. The engagement plates 651 to 656 extend upward from the carriage 6. As shown in FIG. 6, an engagement hole 650 is provided in an upper end portion of the engagement plate 651. The structures of the engagement plates 652 to 656 are the same as the structure of the engagement plate 651.

As shown in FIG. 4, the arms 71 to 76 are each positioned in substantially the center, in the front-rear direction, of the mounting portion 61. The structures of the arms 71 to 76 are all the same, so only the structure of the arm 71 will be described and the description of the arms 72 to 76 will be omitted. The structure of the arm 71 will be described with reference to the arm 71 in a released position, which will be described later, shown in FIG. 6 and FIG. 7.

Figure 7:
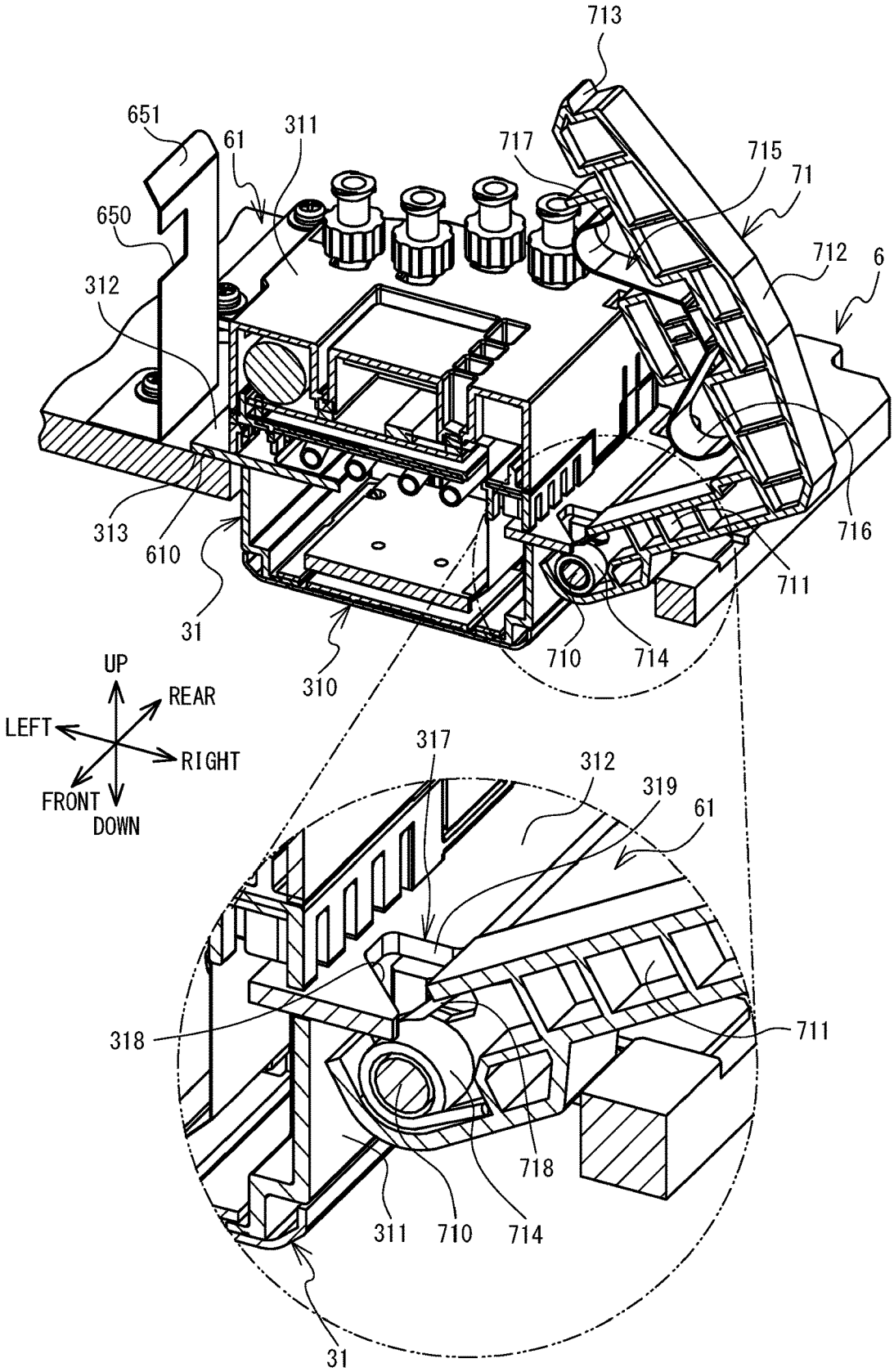
FIG. 7 is a sectional perspective view taken along arrow A-A in FIG. 5 when an arm is in a released position.

As shown in FIG. 6 and FIG. 7, the arm 7 is substantially L-shaped when viewed from the back, and is provided with a base end portion 711, an extension portion 712, and a tip end portion 713. The base end portion 711 extends diagonally upward to the right from the right end portion of the opening in the mounting portion 61. The lower end portion of the base end portion 711 is open to the left, and is fixed to the carriage 6. More specifically, the base end portion 711 is supported by a shaft 710. The shaft 710 is provided on the right end portion of the opening in the mounting portion 61, and extends in the front-rear direction.

A left-right hold down spring 714 is mounted on the shaft 710. The left-right hold down spring 714 is a torsion coil spring. One end portion 718 of the left-right hold down spring 714 is exposed to the left from an opening in the lower end portion of the base end portion 711.

The extension portion 712 extends diagonally upward to the left from the upper end portion of the base end portion 711. The left end portion and the right end portion of the extension portion 712 both open downward. An up-down hold down spring 715 is provided inside the extension portion 712. The up-down hold down spring 715 is a plate spring having a W-shape when viewed from the front. Hereinafter, the right side of the two bottom portions of the up-down hold down spring 715 will be referred to as a right hold down portion 716, and the left side will be referred to as a left hold down portion 717. The right hold down portion 716 protrudes downward from an opening in the right end portion of the extension portion 712. The left hold down portion 717 protrudes downward from an opening in the left end portion of the extension portion 712. The tip end portion 713 extends in a hook shape to the left from the left end portion of the extension portion 712.

Figure 8:
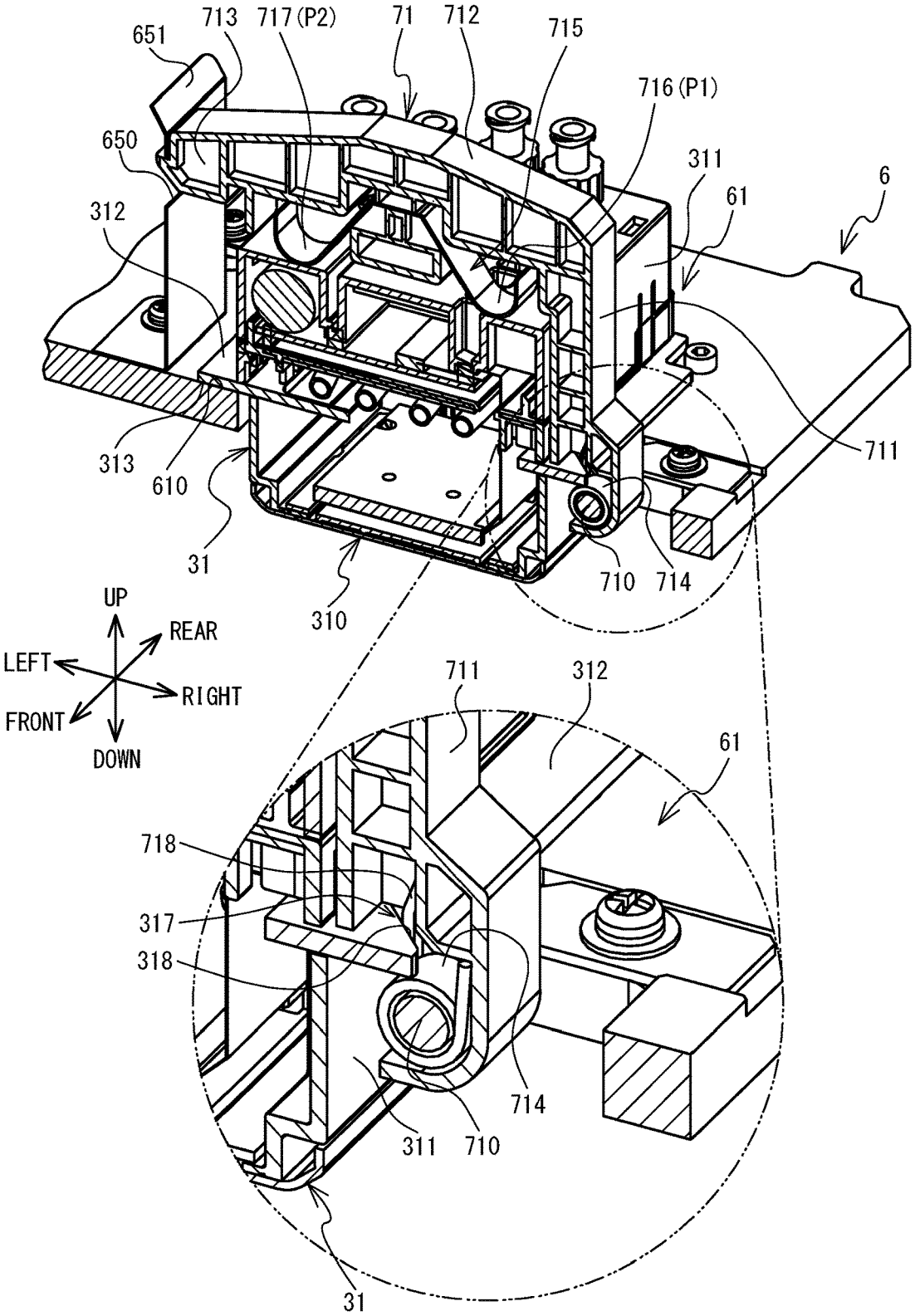
FIG. 8 is a sectional perspective view taken along arrow A-A in FIG. 5 when the arm is in a fixed position.

According to this structure, the arm 71 can move between a fixed position shown in FIG. 5 and FIG. 8 and the released position shown in FIG. 6 and FIG. 7 by rotating around the shaft 710. As shown in FIG. 5 and FIG. 8, in the fixed position, the arm 71 fixes the head 31 mounted to the mounting portion 61 in the front-rear, left-right, and up-down directions with respect to the mounting portion 61. In this case, the tip end portion 713 engages with the engagement hole 650. As shown in FIG. 6 and FIG. 7, in the released position, the arm 71 unfixes the head 31 with respect to the mounting portion 61. In this case, the operator can attach or detach the head 31 to or from the mounting portion 61.

As shown in FIG. 5 and FIG. 6, three adjustment members 67 to 69, a receiving portion 610, and three pins 620, 630, and 640 are provided around the mounting portion 61. The adjustment member 67 is fixed in front and diagonally to the left of the mounting portion 61. A plurality of grooves are formed in the right surface of the adjustment member 67. The plurality of grooves in the adjustment member 67 extend in the up-down direction and are lined up in an arc-shape centered around the rotational center of a receiving portion 621 that will be described later.

The adjustment member 68 is fixed to the rear and diagonally to the left of the mounting portion 61. A plurality of grooves are formed on the right surface of the adjustment member 68. The plurality of grooves on the adjustment member 68 extend in the up-down direction, and are lined up in an arc-shape centered around the rotational center of a receiving portion 631 that will be described later.

The adjustment member 69 is fixed in front and diagonally to the right of the mounting portion 61. A plurality of grooves are formed on the rear surface of the adjustment member 69. The plurality of grooves on the adjustment member 69 extend in the up-down direction, and are lined up in an arc-shape centered around the rotational center of the receiving portion 641 that will be described later.

The receiving portion 610 is the upper surface of the mounting portion 61 that is around the opening. The pin 620 is provided to the left of the center, in the left-right direction, and in front of the opening in the mounting portion 61, and is provided with the receiving portion 621 and a rotation portion 622. The receiving portion 621 has a circular shape when viewed from above, and is rotatably supported by the mounting portion 61. The rotational center of the receiving portion 621 is offset from the center of the circle of the receiving portion 621. Therefore, when the receiving portion 621 rotates, the position of the outer circumference of the receiving portion 621 in the radial direction changes. The rotation portion 622 is fixed to the receiving portion 621 and extends substantially to the left from the receiving portion 621. The front end of the rotation portion 622 fits into any one of the plurality of grooves on the adjustment member 67. An operator can cause the receiving portion 621 to rotate by operating the rotation portion 622.

The pin 630 is provided to the left of the center, in the left-right direction, and to the rear of the opening in the mounting portion 61, and is provided with the receiving portion 631 and a rotation portion 632. The pin 640 is provided to the right of the pin 620, and in front of the opening in the mounting portion 61, and is provided with the receiving portion 641 and a rotation portion 642. The structures of the pins 630 and 640 are the same as the structure of the pin 620, so a description of the structures of the pins 630 and 640 will be omitted.

A fixing method for fixing the head 31 to the mounting portion 61 will now be described with reference to FIG. 5 to FIG. 8. As shown in FIG. 6, the operator mounts the head 31 to the mounting portion 61 by pointing the nozzle surface 310 downward and pointing the notch 317 to the right, and then inserting the head body 311 into the opening in the mounting portion 61 while the arm 71 is in the released position.

As shown in FIG. 7, the portion of the head body 311 that is lower than the reference plate 312 protrudes downward from the opening in the mounting portion 61. The contact portion 313 contacts the receiving portion 610. The notch 317 faces the opening in the base end portion 711 from the left. As shown in FIG. 5, the contact portion 314 faces the receiving portion 621 from the right. The contact portion 315 faces the receiving portion 631 from the right. The contact portion 316 faces the receiving portion 641 from the rear.

The operator then rotates the arm 71 in the counterclockwise direction, when viewed from the front, around the shaft 710 from the released position shown in FIG. 7 toward the fixed position shown in FIG. 8. In this case, the one end portion 718 of the left-right hold down spring 714 first contacts the right end portion of the inclined surface 318, and then moves toward the left end portion of the inclined surface 318 while pushing the inclined surface 318 to the left. As a result, the urging force to the left from the left-right hold down spring 714 as the arm 71 rotates is divided in two directions, i.e., to the left and forward, and acts on the head 31. Consequently, the head 31 moves to the left and forward, such that the contact portion 314 is pressed against the receiving portion 621 from the right, the contact portion 315 is pressed against the receiving portion 631 from the right, and the contact portion 316 is pressed against the receiving portion 641 from the rear, as shown in FIG. 5. As a result, the head 31 is positioned in the left-right direction and the front-rear position with respect to the mounting portion 61.

As shown in FIG. 8, after the one end portion 718 of the left-right hold down spring 714 contacts the inclined surface 318, the right hold down portion 716 of the up-down hold down spring 715 presses on the upper surface of the head body 311 from above in response to the rotation of the arm 71. Then, the left hold down portion 717 of the up-down hold down spring 715 presses on the upper surface of the head body 311 from above. That is, the up-down hold down spring 715 presses positions P1 and P2 of the upper surface of the head body 311 downward at two locations, i.e., the right hold down portion 716 and the left hold down portion 717. The positions P1 and P2 are positions where the right hold down portion 716 and the left hold down portion 717 press on the head body 311, respectively.

As shown in FIG. 5, in the present embodiment, the positions P1 and P2 are positioned within a rectangular region D surrounded by the four springs 481 to 484 in a plan view, in a state in which the head 31 is capped by the cap 41.

As shown in FIG. 8, the contact portion 313 is pressed against the receiving portion 610 by the arm 71 pressing the head 31 downward with the up-down hold down spring 715. As a result, the head 31 is positioned in the up-down direction with respect to the mounting portion 61.

With this, movement of the arm 71 to the fixed position is completed. That is, the head 31 is fixed in all directions, i.e., front-rear, left-right, and up-down, with respect to the mounting portion 61, simply by the operator moving the arm 71 from the released position to the fixed position. The operator fixes the arm 71 in the fixed position by hooking the tip end portion 713 in the engagement hole 650.

In the present embodiment, when the arm 71 is in the fixed position shown in FIG. 8, the static frictional force between the up-down hold down spring 715 and the head 31 is smaller than the urging force on the head 31 from the left-right hold down spring 714. Therefore, as shown in FIG. 5, in this state, when the operator rotates the rotating portion 622, for example, the head 31 moves so as to keep the contact portions 314, 315, and 316 in contact with the receiving portions 621, 631, and 641 as the position of the right end of the receiving portion 621 is displaced in the left-right direction. Similarly, when the operator rotates the rotating portions 632 and 642, the head 31 moves so as to keep the contact portions 314, 315, and 316 in contact with the receiving portions 621, 631, and 641. Therefore, the operator can finely adjust the position of the head 31 in the front-rear and left-right directions and the orientation of the head 31 in the horizontal direction while the arm 71 is in the fixed position, without moving the arm 71 to the released position.

As shown in FIG. 8, when the operator removes the tip end portion 713 from the engagement hole 650 while the arm 71 is in the fixed position, the arm 71 springs back, rotating in the clockwise direction, when viewed from the front, around the shaft 710 by the urging force of the up-down hold down spring 715. Thus, the operator can easily move the arm 71 from the fixed position shown in FIG. 8 to the released position shown in FIG. 7.

As described above, in the present embodiment, when the arm 71 is moved from the released position to the fixed position while the head 31 is mounted on the mounting portion 61, the head 31 is fixed in all directions, i.e., front-rear, left-right, and up-down with respect to the mounting portion 61. That is, the operator can fix the head 31 in all directions, i.e., front-rear, left-right, and up-down, with respect to the mounting portion 61 just by moving the arm 71 from the released position to the fixed position. Thus, the printer 1 enables the head 31 to be easily fixed to the mounting portion 61. Moreover, the operator can easily perform work such as maintenance and replacing the head 31, simply by moving the arm 71 from the fixed position to the released position.

The arm 71 is fixed to the carriage 6, so the operator can easily operate the arm 71. Moreover, both the mounting portion 61 and the arm 71 are provided on the carriage 6, so the printer 1 does not need to be provided with a member to which the arm 71 is fixed other than the carriage 6.

When the arm 71 rotates around the shaft 710 and moves from the released position to the fixed position, the up-down hold down spring 715 presses on the head 31 from above, and the left-right hold down spring 714 presses on the head 31 from the right. Therefore, the arm 71 can move between the released position and the fixed position simply by rotating around the shaft 710. Therefore, the printer 1 enables the head 31 to be easily fixed to the mounting portion 61.

When the arm 71 moves from the released position to the fixed position, the left-right hold down spring 714 presses on the inclined surface 318 from the right. As a result, the force with which the arm 71 pushes the head 31 to the left is divided into a leftward force and a forward force by the inclined surface 318. Therefore, the arm 71 does not need to be provided with a structure for pushing the head 31 forward other than the left-right hold down spring 714. Thus, the printer 1 enables the head 31 to be fixed to the mounting portion 61 by a simple structure.

When the nozzle surface 310 is capped with the cap 41 from below, the upward force from the four springs 481 to 484 and the downward force from the arm 71 act on the head 31. The positions P1 and P2 are both located within the rectangular region D, so a rotation moment from the downward force from the arm 71 and the upward force from the springs 481 to 484 is inhibited from being generated. Therefore, with the printer 1, the cap 41 can be inhibited from coming off of the head 31 when the nozzle surface 310 is capped with the cap 41.

The three mounting portions 61 to 63 are lined up in the front-rear direction. The shaft 710 extends in the front-rear direction, so even if the arm 71 moves between the fixed position and the released position, the position of the arm 71 in the front-rear direction will not change. Similarly, the positions of the arms 72 and 73 in the front-rear direction will also not change even if the arms 72 and 73 move between the fixed position and the released position. Therefore, the arms 71 to 73 will not likely interfere with each other even if they move between the fixed position and the released position. As a result, the arms 71 to 73 are unlikely to impede each other's movement, so with the printer 1, the heads 31 to 33 can easily be fixed to the mounting portions 61 to 63. Similarly, the arms 74 to 76 are unlikely to impede each other's movement, so with the printer 1, the heads 34 to 36 can easily be fixed to the mounting portions 64 to 66.

As described above, even if the arms 71 and 74 move between the fixed position and the released position, the position of the arms 71 and 74 in the front-rear direction will not change. Moreover, the two mounting portions 61 and 64 are offset in the front-rear direction. Therefore, even if one of the arms 71 or 74 moves between the fixed position and the released position, that arm 71 or 74 will not likely interfere with the other arm 71 or 74. As a result, the arms 71 and 74 are unlikely to impede each other's movement, so with the printer 1, the heads 31 and 34 can easily be fixed to the mounting portions 61 and 64. Similarly, movement of the arms 72 and 75 and the arms 73 and 76 are unlikely to impede each other's movement, so with the printer 1, the heads 32, 33, 35, and 36 can easily be fixed to the mounting portions 62, 63, 65, and 66.

The mounting portion 61 is offset toward the rear with respect to the mounting portion 64, so there is a region to the right of the mounting portion 64 and in front of the mounting portion 61. The printer 1 can effectively utilize this region as a movement region for the arm 74.

The heads 31 to 33 and the heads 34 to 36 are each lined up in the left-right direction, and the supply tubes 51 to 53 extend toward the right from the heads 31 to 33, and the supply tubes 54 to 56 extend toward the left from the heads 34 to 36. Therefore, the supply tubes 51 to 53 are unlikely to interfere with the heads 34 to 36, and the supply tubes 54 to 56 are unlikely to interfere with the heads 31 to 33. As a result, the printer 1 enables the heads 31 to 36 to be easily attached and detached to and from the mounting portions 61 to 66. The circulation tubes 84 to 86 also extend similarly to the supply tubes 51 to 53, so the printer 1 enables the heads 31 to 36 to be attached and detached even more easily to and from the mounting portions 61 to 66.

The cables 91 to 96 extend toward the right from the heads 31 to 36, respectively. The circuit board 90 is provided only in one direction in the left-right direction of the carriage 6, and the cables 91 to 96 extend in the same direction from the heads 31 to 36, so the operator can easily manage the cables 91 to 96. Therefore, the operator can easily perform work such as connecting the cables 91 to 96 to the heads 31 to 36 and the circuit board 90, and maintaining the cables 91 to 96, and the like.

A predetermined interval is provided between the heads 31 and 32 in the front-rear direction, so the cable 91 and the supply tube 52 will not likely interfere with each other. Similarly, the cables 92, 94, and 95 will not likely interfere with the supply tubes 53, 55, and 56, respectively. As a result, with the printer 1, the cables 91, 92, 94, and 95 and the supply tubes 52, 53, 55, and 56 are easy to manage. Similarly, with the printer 1, the circulation tubes 82, 83, 85, and 86 are easy to manage.

The head 34 is offset toward the front with respect to the head 31, so the cables 91 and 94 will not likely interfere with each other. Similarly, the cables 92 and 95 will not likely interfere with each other, nor will the cables 93 and 96 likely interfere with each other. As a result, with the printer 1, the cables 91 to 96 are easy to manage.

The cable 91 connects to the front end portion of the head 31, and the supply tube 51 connects to the rear end portion of the head 31. The arm 71 is provided between the cable 91 and the supply tube 51 in the front-rear direction of the head 31. Moreover, the cable 91, the supply tube 51, and the arm 71 all extend in the left-right direction. Therefore, the arm 71 will not likely interfere with the cable 91 or the supply tube 51 even if the arm 71 rotates around the shaft 710. As a result, with the printer 1, the head 31 can easily be fixed to the mounting portion 61. Similarly, with the printer 1, the heads 32 to 36 can also easily be fixed to the mounting portions 62 to 66.

The present disclosure may be modified in various ways from the above embodiment. The various modified examples described below can be combined as long as there are no contradictions. The present disclosure is not limited to the printer 1, and can also be applied to a pretreatment agent discharge device, for example. The pretreatment agent discharge device is provided with a head for discharging a pretreatment agent. The pretreatment agent is a liquid for improving ink fixing and color development, etc., and is discharged onto a medium before printing.

In the foregoing embodiment, the up-down hold down spring 715 presses on the head 31 at two locations, but the up-down hold down spring 715 may press on the head 31 at one location, or may press on the head 31 at three or more locations. The up-down hold down spring 715 is not limited to a plate spring, and may be a compression coil spring or a disc spring or the like. Similarly, the left-right hold down spring 714 is also not limited to a torsion coil spring. Moreover, an elastic member of sponge or rubber or the like may be used in place of the up-down hold down spring 715 and the left-right hold down spring 714. The up-down hold down spring 715 and the left-right hold down spring 714 may be omitted. That is, the arm 71 may directly contact the inclined surface 318, instead of contacting the inclined surface 318 via the left-right hold down spring 714, and push the head 31 to the left and forward, and may directly contact the head body 311, instead of contacting the head body 311 via the up-down hold down spring 715, and push the head 31 downward.

In the foregoing embodiment, the shaft 710 may extend in the left-right direction. In this case, the shaft 710 need only be provided to the front or rear of the mounting portion 61, for example. Similarly, the shaft 710 may extend at an angle with respect to the left-right direction and the front-rear direction, or may extend in the up-down direction. In the foregoing embodiment, the direction in which the shaft extends and the position in which the shaft is arranged is the same for all of the arms 71 to 76, but they may be different for each arm 71 to 76.

In the foregoing embodiment, the shaft 710 may be omitted. For example, shafts may be provided that extend in the up-down direction from the four corners of the mounting portions 61, and the arm 71 may be supported in a manner able to move in the up-down direction by these four shafts. The arm 71 may be fixed to a member other than the carriage 6.

In the foregoing embodiment, the number of springs 481 to 484 is not limited to four, and may be one or two, or the springs 481 to 484 may be omitted. A plurality of three or more springs are preferably provided in order to stabilize capping. For example, one spring may be provided instead of the springs 481 to 484, and this one spring may press on the cap 41 at a plurality of locations (for example, three or more locations). An elastic member of sponge or rubber or the like may be used instead of the springs 481 to 484.

In the foregoing embodiment, the heads 31 to 36 are mounted on all of the mounting portions 61 to 66. Alternatively, any of the heads 31 to 36, for example, only the heads 31, 33, 34, and 36, may be mounted on the mounting portions 61, 63, 64, and 66, or one may be mounted on any one of the mounting portions 61 to 66. The type of liquid discharged from each of the heads 31 to 36 is not limited to the foregoing embodiment. For example, the head 31 may discharge a color ink, or may discharge a discharge agent. Moreover, the various liquids are not limited to those of the foregoing embodiment; various liquids such as white ink, color ink, ink of special colors such as fluorescent colors, discharge agents, and pretreatment agents and the like are conceivable. The various liquids may be supplied to the heads 31 to 36 from a tank instead of from the cartridge 18. Nozzles may be lined up in a row on the nozzle surface 310.

The number of the mounting portions 61 to 66 is not limited to six, as long as there is at least one. For example, the printer 1 may be provided with only one row, from among two rows, i.e., the row of the mounting portions 61 to 63 and the row of mounting portions 64 to 66, or may be provided with three or more rows. This row does not have to be formed of three mounting portions, and may be formed of two mounting portions or four or more mounting portions. A plurality of the mounting portions may be lined up in only the left-right direction, from among the front-rear direction and the left-right direction. The printer 1 may be provided with a so-called linehead as the heads 31 to 36. In this case, the printer 1 is provided with a fixed plate instead of the carriage 6. The fixed plate maintains a distance in the up-down direction between the heads 31 to 36 and the print medium. The mounting portions 61 to 66 are provided on the fixed plate.

In the foregoing embodiment, the mounting portion 62 is offset forward with respect to the mounting portion 64, and does not overlap with the mounting portion 64 in the left-right direction. Alternatively, the mounting portion 62 may be offset to the rear with respect to the mounting portion 64, and may overlap with the mounting portion 64 in the left-right direction. The positional relationship between the mounting portion 63 and the mounting portion 65 can be modified in the same manner as the positional relationship between the mounting portion 62 and the mounting portion 64.

In the foregoing embodiment, the supply tubes 51 to 53 and the supply tubes 54 to 56 extend in opposite directions from the heads 31 to 33 and the heads 34 to 36, respectively. Alternatively, the supply tubes 51 to 56 may all extend from the heads 31 to 36 in the same direction, e.g., to the left or to the right, or may extend in the front-rear direction or the up-down direction. If three or more mounting portions are lined up in the left-right direction, the supply tube connected to the head mounted on the leftmost mounting portion preferably extends to the left, and the supply tube connected to the head mounted on the rightmost mounting portion preferably extends to the right. More specifically, a supply tube connected to the head mounted on a mounting portion to the left of the center in the left-right direction preferably extends to the left, and a supply tube connected to the head mounted on a mounting portion to the right of the center in the left-right direction preferably extends to the right. The circulation tubes 81 to 86 can also be modified in the same manner as the supply tubes 51 to 56.

In the foregoing embodiment, the circuit board 90 may be provided on the left side, in front of, to the rear of, above, or below the carriage 6, instead of on the right side of the carriage 6. In the foregoing embodiment, there is only one circuit board 90, but a plurality of circuit boards, for example, another circuit board, may be provided. This other circuit board may be provided on the left side of the mounting portions 64 to 66, for example. In this case, for example, the cables 94 to 96 may extend to the left from the heads 34 to 36, respectively, and be connected to the other circuit board instead of to the circuit board 90. That is, the cables 91 to 96 do not need to extend in the same direction. The cables 91 to 96 may extend in the front-rear direction or the up-down direction.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A liquid discharge device comprising:

a mounting portion to which a head configured to discharge a liquid is mounted, and an arm configured to move between a fixed position where the head mounted on the mounting portion is fixed in a first direction, a second direction, and a third direction, all of which are orthogonal to each other, with respect to the mounting portion, and a released position where the head is unfixed from the mounting portion;

wherein the mounting portion is provided on a plate configured to maintain a distance between the head and a print medium, and one end of the arm is fixed to the plate;

wherein the arm is configured to move between the fixed position and the released position by rotating around a shaft provided on the plate, and extending in an axial direction that is either one of the first direction and the second direction, and has a first pressing portion configured to press on the head from one direction in the third direction, and a second pressing portion configured to press on the head from one direction in an orthogonal directions, either the other of the first direction and the second direction, when the arm moves from the released position to the fixed position;

a cap configured to cover, from the other direction in the third direction, a nozzle surface provided on the head, and an elastic member configured to urge the cap in one direction in the third direction, at a plurality of locations that is three or more locations, wherein the position where the first pressing portion presses on the head when the arm is positioned in the fixed position is positioned within a region of the head surrounded by the plurality of locations when viewed from the third direction, when the head is positioned in a position overlapping with the cap in the third direction.

2. The liquid discharge device according to claim 1, wherein the head has an inclined surface extending from one direction to the other direction in the axial direction from one direction to the other direction in the orthogonal direction, and the second pressing portion presses on the inclined surface from the one direction in the orthogonal direction when the arm moves from the released position to the fixed position.

3. The liquid discharge device according to claim 1, further comprising:

a plurality of the mounting portions lined up in the first direction, wherein the axial direction is the first direction.

4. The liquid discharge device according to claim 1, further comprising:

a plurality of the mounting portions lined up in the second direction, wherein a pair of the mounting portions adjacent to each other in the second direction are arranged in positions offset from each other in the first direction, and the axial direction is the first direction.

5. The liquid discharge device according to claim 1, further comprising:

a plurality of the mounting portions in which a plurality of rows of a plurality of the mounting portions lined up in the first direction are lined up in the second direction, wherein the plurality of mounting portions lined up in the first direction in one row, from among a pair of rows of the mounting portions adjacent to each other in the second direction, are arranged in positions offset in the first direction from the plurality of mounting portions lined up in the first direction in the other row, and the axial direction is the first direction.

6. The liquid discharge device according to claim 3, further comprising:

a circuit board configured to control the head, and a cable configured to connect the circuit board to the head, wherein a plurality of the cables, a respective one of the cables corresponding to a respective one of a plurality of the heads, extend in one direction or the other direction in the second direction and all in the same direction from all of the heads mounted on a plurality of the mounting portions.

7. A liquid discharge device comprising:

a mounting portion to which a head configured to discharge a liquid is mounted, and an arm configured to move between a fixed position where the head mounted on the mounting portion is fixed in a first direction, a second direction, and a third direction, all of which are orthogonal to each other, with respect to the mounting portion, and a released position where the head is unfixed from the mounting portion;

wherein the mounting portion is provided on a plate configured to maintain a distance between the head and a print medium, and one end of the arm is fixed to the plate;

wherein the arm is configured to move between the fixed position and the released position by rotating around a shaft provided on the plate, and extending in an axial direction that is either one of the first direction and the second direction, and has a first pressing portion configured to press on the head from one direction in the third direction, and a second pressing portion configured to press on the head from one direction in an orthogonal directions, either the other of the first direction and the second direction, when the arm moves from the released position to the fixed position;

a plurality of the mounting portions lined up in the second direction, wherein a pair of the mounting portions adjacent to each other in the second direction are arranged in positions offset from each other in the first direction, and the axial direction is the first direction;

a tube connected to the head, through which the liquid supplied to the head flows, wherein the tube connected to the head mounted on the mounting portion positioned on one side in the second direction extends in one direction in the second direction from the head, and the tube connected to the head mounted on the mounting portion positioned on the other side in the second direction extends in the other direction in the second direction from the head.

* * * * *